US008769987B2

(12) United States Patent
Mehta

(10) Patent No.: US 8,769,987 B2
(45) Date of Patent: Jul. 8, 2014

(54) GEMSTONE

(75) Inventor: Paras Paresh Mehta, Mumbai (IN)

(73) Assignee: Dimexon Diamonds Ltd., Mumbai, Maharashtra (IN)

( * ) Notice: Subject to any disclaimer, the term of this patent is extended or adjusted under 35 U.S.C. 154(b) by 0 days.

(21) Appl. No.: 12/955,055

(22) Filed: Nov. 29, 2010

(65) Prior Publication Data

US 2011/0146349 A1 Jun. 23, 2011

Related U.S. Application Data

(60) Provisional application No. 61/265,428, filed on Dec. 1, 2009.

(51) Int. Cl.
*A44C 17/00* (2006.01)

(52) U.S. Cl.
USPC ..... 63/32

(58) Field of Classification Search
USPC ..... 63/32, 26–27; D11/89–90
See application file for complete search history.

(56) References Cited

U.S. PATENT DOCUMENTS

| | | | | | |
|---|---|---|---|---|---|
| 2,364,031 | A | * | 11/1944 | Suderov | 63/32 |
| 4,306,427 | A | * | 12/1981 | Urban | 63/32 |
| D460,711 | S | * | 7/2002 | Cohen | D11/90 |
| 6,698,239 | B2 | * | 3/2004 | Wueste | 63/32 |
| D503,354 | S | * | 3/2005 | So | D11/90 |
| 6,990,833 | B2 | | 1/2006 | Smith | |
| D526,593 | S | * | 8/2006 | Zaicik | D11/90 |
| D528,459 | S | * | 9/2006 | Zaicik | D11/90 |
| D529,836 | S | * | 10/2006 | Sanghvi | D11/90 |
| D530,642 | S | * | 10/2006 | Botha | D11/90 |
| D547,691 | S | * | 7/2007 | Hodara et al. | D11/90 |
| 7,249,471 | B2 | | 7/2007 | Kawabuchi et al. | |
| D550,118 | S | * | 9/2007 | Botha | D11/90 |
| D555,032 | S | * | 11/2007 | So | D11/90 |
| D632,205 | S | * | 2/2011 | Mehta | D11/90 |
| 7,878,025 | B2 | | 2/2011 | Rydlewicz | |
| 8,156,760 | B2 | * | 4/2012 | Gad | 63/32 |
| 2005/0011226 | A1 | * | 1/2005 | So | 63/32 |
| 2006/0037360 | A1 | * | 2/2006 | So | 63/32 |
| 2006/0086143 | A1 | | 4/2006 | Biro | |
| 2006/0137674 | A1 | | 6/2006 | Aoyagi | |

(Continued)

FOREIGN PATENT DOCUMENTS

| | | |
|---|---|---|
| CN | 1852669 | 10/2006 |
| CN | 100386043 C | 5/2008 |

(Continued)

OTHER PUBLICATIONS

Extend European search report dated Jun. 13, 2012 in counterpart European Patent Application No. 10015134.9.

(Continued)

*Primary Examiner* — Jack W. Lavinder
*Assistant Examiner* — Abigail Morrell
(74) *Attorney, Agent, or Firm* — Lewis Roca Rothgerber LLP

(57) ABSTRACT

The present invention relates to a gemstone comprising a girdle, a crown, and a pavilion. The crown has a table, ten star facets surrounding the table, ten bezel facets aligned between the star facets, and twenty upper girdle facets aligned between the bezel facets. The pavilion is provided with ten pavilion main facets, twenty pavilion hook facets aligned between the pavilion main facets, and ten pavilion star facets aligned between the pavilion hook facets.

9 Claims, 3 Drawing Sheets

(56) References Cited

U.S. PATENT DOCUMENTS

| | | | | |
|---|---|---|---|---|
| 2009/0038341 | A1 | 2/2009 | Zheng | |
| 2009/0308104 | A1* | 12/2009 | Gad | 63/32 |
| 2010/0154473 | A1 | 6/2010 | Xheng | |

FOREIGN PATENT DOCUMENTS

| | | | |
|---|---|---|---|
| CN | 201108098 | Y | 9/2008 |
| CN | 201119484 | Y | 9/2008 |
| CN | 201153610 | Y | 11/2008 |

OTHER PUBLICATIONS

Chinese Patent Application No. 2010-10578126.9, Office Action dated Dec. 4, 2013.

* cited by examiner

GEMSTONE

CROSS-REFERENCE TO RELATED APPLICATIONS

This application claims priority to co-pending U.S. Provisional Patent Application Ser. No. 61/265,428, filed Dec. 1, 2009, the entirety of which is incorporated by reference herein.

FIELD OF THE INVENTION

The present invention relates to a gemstone and more particularly, to a gemstone having a unique cut and method of cutting the gemstone.

BACKGROUND OF THE INVENTION

The round brilliant cut is the most popular cut shape for diamonds. Diamonds have various characteristics and three of the main characteristics are brilliance, dispersion and scintillation.

Brilliance is an essential attribute of a diamond and it generally refers to the amount of light that impinges on the top of the diamond and reflects back. Bright diamonds return lots of light from the surroundings back to an observer.

Dispersion, which is also known as fire, refers to the prism of light refracted from within a cut diamond and relates to the rainbow colours that are emitted from the gemstone as it is viewed from different angles when a diamond moves relative to an observer.

Scintillation is the intense sparkles in a diamond as the diamond moves.

The light performance of a diamond is impacted by, among other things, the number, shape, angles and arrangement of facets on the cut diamond. A slight variation in one factor can alter the brilliance and appearance of the diamond.

There are a variety of brilliant gemstone cuts available on the market. A conventional round brilliant cut diamond consists of 57 facets, or 58 facets including a culet. However, even with this number of facets, a conventional round brilliant cut diamond does not address a specific need of a particular way of having a gemstone cut that exhibits excellent brilliancy, scintillation and dispersion.

There is therefore a need for a new gemstone cut and corresponding method for cutting a gemstone which uniquely maximizes and balances the features of brilliance, scintillation and dispersion of gemstones.

SUMMARY OF INVENTION

It is the object of the present invention to provide a gemstone, with improved characteristics of brilliance, scintillation and dispersion over the prior art or to at least provide the public with a useful choice.

It is also an object of the present invention to provide a method for cutting a gemstone with improved characteristics of brilliance, scintillation and dispersion over the prior art or at least provides the public with a useful choice.

According to one aspect of the invention, a gemstone is provided, comprising a girdle, a crown extending in a first direction from the girdle, a pavilion extending in a second direction from the girdle, opposite the first direction. The crown comprises a table, ten star facets surrounding the table, ten bezel facets aligned between the star facets and twenty upper girdle facets aligned between the bezel facets. The pavilion comprises ten pavilion main facets extending concentrically from a point of the pavilion distant from the girdle, twenty substantially triangular pavilion hook facets aligned between the pavilion main facets and ten substantially triangular pavilion star facets aligned between the pavilion hook facets, wherein the pavilion main facets are formed at an angle between 40.75° and 41.5°, the pavilion hook facets are formed at an angle between 41.50° and 42.25° and the pavilion star facets are formed at an angle between 45.75° and 46.50°, relative to a plane parallel to a horizontal plane of the girdle.

Preferably, each of the pavilion hook facets is provided adjacent to, and forms a common edge with another pavilion hook facet to form a pair of pavilion hook facets, each of the pair of pavilion hook facets is aligned between two adjacent pavilion main facets.

Preferably, the pavilion star facets are aligned around periphery of the pavilion, wherein each of the pavilion star facets has a first side forming a first common edge with a side of a first pavilion hook facet of the pair of pavilion hook facets and a second side forming a second common edge with a side of a second pavilion hook facet of the pair of pavilion hook facets.

Preferably, a projection of ten heart shapes, ten arrow shapes and a flora pattern are observed when the gemstone is exposed to light.

According to another aspect of the invention, a method of cutting a gemstone having a crown, a girdle and a pavilion is provided, the method comprising forming ten pavilion main facets at the pavilion at an angle between 40.75° and 41.50° relative to a plane parallel to a horizontal plane of the girdle, forming twenty substantially triangular pavilion hook facets between the pavilion main facets at an angle between 41.50° and 42.25° relative to the plane parallel to the horizontal plane of the girdle and forming ten substantially triangular pavilion star facets at an angle between 45.75° and 46.50° relative to the plane parallel to the horizontal plane of the girdle.

Preferably, the method further comprises aligning each of the pavilion hook facets adjacent to, and forming a common edge with another pavilion hook facet to form a pair of pavilion hook facets and aligning each of the pair of pavilion hook facets between two adjacent pavilion main facets.

Preferably, the method further comprises aligning the pavilion star facets around periphery of the pavilion with each of the pavilion star facets having a first side forming a first common edge with a side of a first pavilion hook facet of the pair of pavilion hook facets and a second side forming a second common edge with a side of a second pavilion hook facet of the pair of pavilion hook facets.

Preferably, the method further comprises forming a table at the crown, forming ten star facets surrounding the table, forming ten bezel facets between the star facets and forming twenty upper girdle facets around the periphery of the crown and aligning them between the bezel facets.

Preferably, the method further comprises aligning each of the bezel facets between two adjacent star facets, aligning each of the upper girdle facets adjacent to, and forming a common edge with another upper girdle facet to form a pair of upper girdle facets; and aligning each of the pair of upper girdle facets between two adjacent bezel facets.

BRIEF DESCRIPTION OF DRAWINGS

For the purposes of illustrating the invention, there is shown in the drawings a form which is presently preferred. It is being understood however that this invention is not limited to the precise arrangements shown.

DETAILED DESCRIPTION OF THE INVENTION

Figure 1:
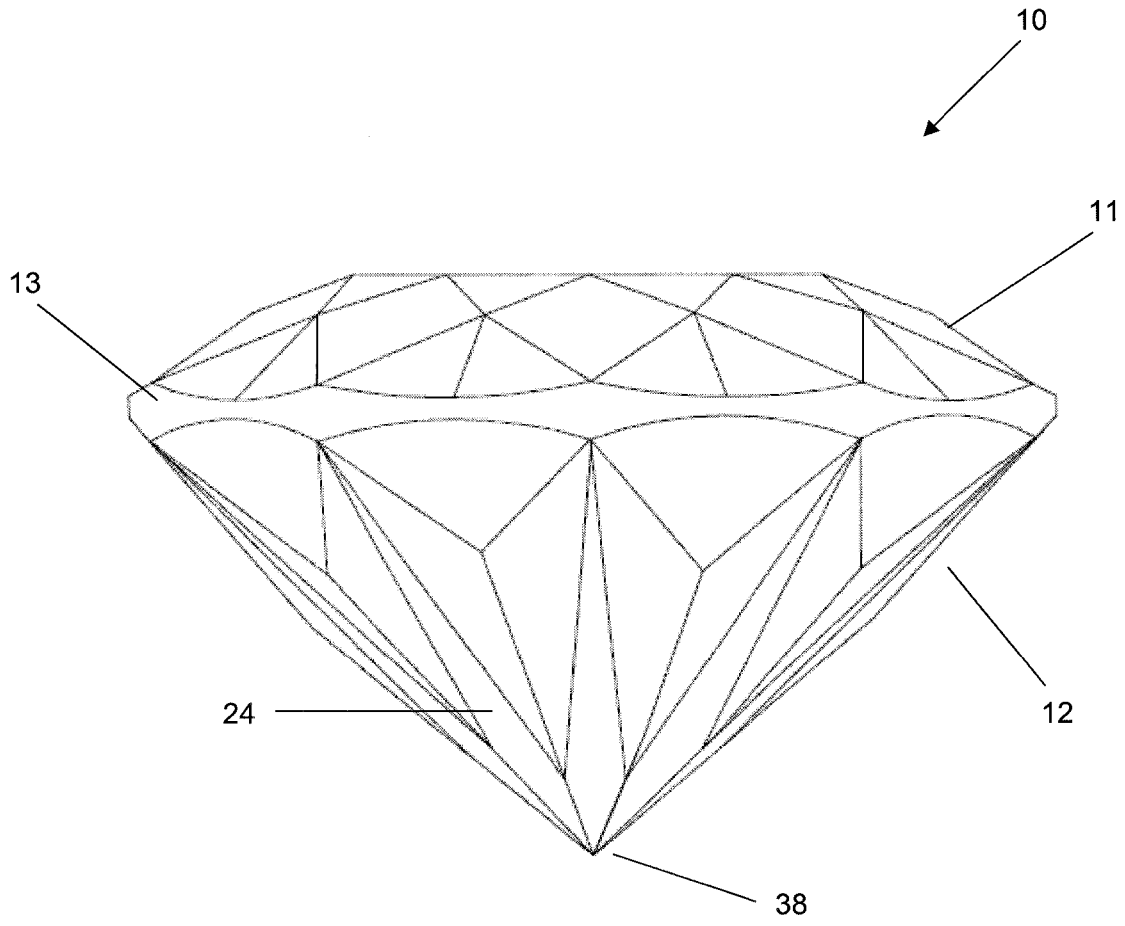
FIG. 1 is a side elevational view of a gemstone according to the present invention.

Referring now to the drawings, preferred embodiments of the present invention are described more particularly.

FIG. 1 is a side elevational view of a circular cut gemstone 10 according to one embodiment of the present invention. As shown in FIG. 1, the gemstone 10 includes a top or crown 11, a base or pavilion 12, and a girdle 13 provided on the lateral surface along the boundary of the crown 11 and the pavilion 12 as shown in FIG. 1.

Figure 2:
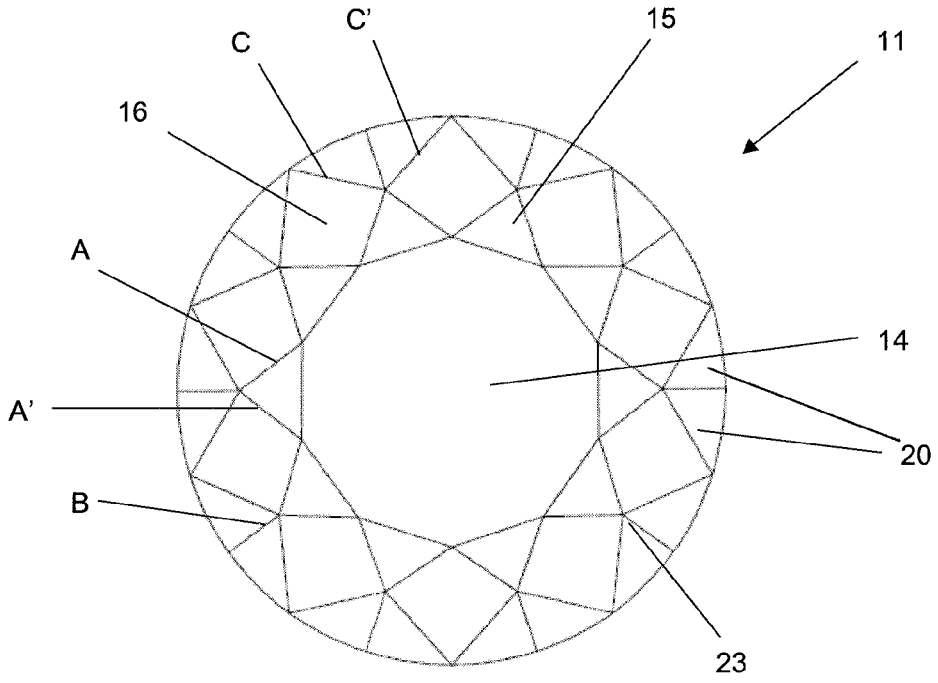
FIG. 2 is a top view of the gemstone shown in FIG. 1.

FIG. 2 is a top view showing the crown 11 of the gemstone 10 of FIG. 1. As shown in FIG. 2, the crown 11 includes a table 14 and ten substantially equally-spaced triangular facets known as star facets 15. The star facets 15 are aligned immediately surrounding the table 14 and adjacent to the table 14. The ten star facets 15 are substantially identical in size.

The crown 11 further includes ten bezel facets 16 extending from the table 14 to the girdle 13. Each of the bezel facets 16 is in the shape of a four sided kite with two of the sides forming a first portion of the bezel facet 16 and the other two sides forming a second portion opposite the first portion of the bezel facet. One side of the first portion of the bezel facet 16 forms a common edge A with a side of a first star facet 15 and another side of the first portion of the bezel facet 16 forms a common edge A' with a side of a second star facet 15 that is aligned adjacent to the first star facet 15. The ten bezel facets 16 are substantially identical in size.

The crown 11 also includes twenty upper girdle facets 20 provided around the periphery of the crown 11. Each of the upper girdle facets 20 is substantially triangular in shape. Each of the upper girdle facets 20 is provided adjacent to, and forms a common edge B with another upper girdle facet to form a pair of upper girdle facet. Each pair of the upper girdle facets is provided between two adjacent bezel facets 16 such that one side of the pair of upper girdle facet forms a common edge C with one side of the second portion of a first bezel facet 16 and a opposite side of the pair of upper girdle facets forms a common edge C' with one side of the second portion of a second bezel facet 16 positioned adjacent to the first bezel facet. Each pair of upper girdle facets together with two adjacent bezel facets and one star facet which is provided between the two adjacent bezel facets are aligned in a manner such that they form a point 23 where the five common facets meet.

Figure 3:
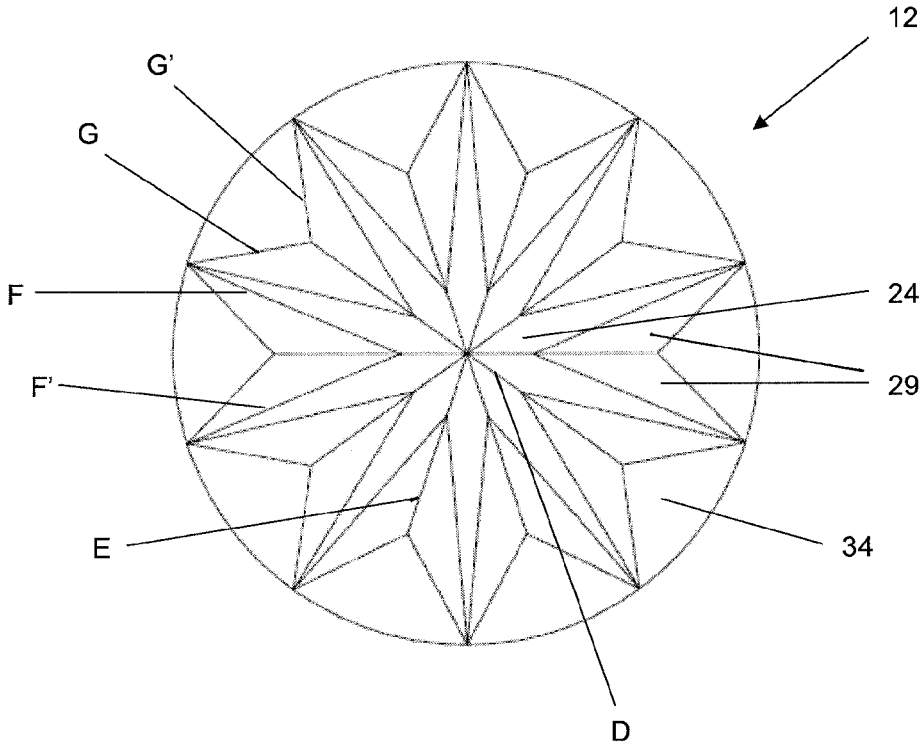
FIG. 3 is a bottom view of the gemstone of FIG. 1.

FIG. 3 is a bottom view showing the pavilion 12 of the gemstone 10 of FIG. 1. As shown in FIG. 3, the pavilion 12 includes ten concentrically substantially equally spaced pavilion main facets 24 extending from a point of the pavilion 12 distant from the girdle, to the girdle 13. Each of the pavilion main facets 24 has four sides, two of which form a first portion of the pavilion main facet 24 and the other two form a second portion of the pavilion main facet 24, opposite the first portion. Each side of the first portion of each of the pavilion main facets 24 is immediately adjacent to, and forms a common edge D with another side of the first portion of another pavilion main facet 24. In a preferred form, the first portion of each of the pavilion main facets 24 is shorter than the second portion of the same pavilion main facet 24.

Between the pavilion main facets 24 are twenty substantially triangular pavilion hook facets 29. Each of the pavilion hook facets 29 is provided adjacent to, and forms a common edge E with another pavilion hook facet to form a pair of pavilion hook facets. Each pair of the pavilion hook facets 29 is provided between two adjacent pavilion main facets 24 at the second portions of the pavilion main facets 24. Each pair of the pavilion hook facets 29 is aligned such that one side of the pair of pavilion hook facets 29 forms a common edge F with one side of a first pavilion main facet 24 and a opposite side of the pair of pavilion hook facets 29 forms a common edge F' with a side of a second pavilion main facet 24 positioned adjacent to the first pavilion main facet 24.

The pavilion 12 further includes ten substantially triangularly shaped pavilion star facets 34 provided around the periphery of the pavilion 12. In a preferred embodiment, each of the pavilion star facets 34 has two substantially straight sides and a substantially curved side that forms part of the circumference of the gemstone 10, although the configuration is not limited as such. Each of the pavilion star facets 34 is provided between the pair of pavilion hook facets 29, with one straight side of the pavilion star facet 34 forming a common edge G with a side of a first pavilion hook facet 29 and another straight side of the pavilion star facet 34 forming a common edge G' with a side of a second pavilion hook facet 29 of the pair of pavilion hook facets 29.

In one embodiment of the invention, the pavilion main facets 34 are formed at an angle between 40.75° and 41.50° relative to a plane parallel to a horizontal plane of the girdle. The pavilion hook facets 29 are formed at an angle between 41.50° and 42.25° relative to the plane parallel to the horizontal plane of the girdle. The pavilion star facets 34 are formed at an angle between 45.75° and 46.50° relative to the plane parallel to the horizontal plane of the girdle. Preferably, the pavilion main facets 34 are formed at an angle of 41°, the pavilion hook facets are formed at an angle of 41.75° and the pavilion star facets 34 are formed at an angle of 46°. The correlation of these facets is done on the basis of the pavilion main facets 24.

In another embodiment of the invention, the point which the pavilion main facets 24 extend from includes a culet 38 (as shown in FIG. 1). This culet can be a point or a planar surface forming an additional facet.

In one embodiment of the invention, the gemstone 10 preferably has a total depth in the range of 59.5% to 63.0% of the total girdle diameter. The girdle preferably has a thickness in the range of 1.2% to 3.5% of the total girdle diameter. The crown 11 preferably has an angle between 33.5° and 35.2° relative to the plane parallel to the horizontal plane of the girdle. The pavilion 12 preferably has an angle between 40.6° and 41.2° relative to the plane parallel to the horizontal plane of the girdle.

The gemstone 10 of the present invention is cut symmetrically with a 10-fold symmetry and having a total of 81 facets, with the crown 11 and the pavilion 12 each having 40 facets. In one embodiment of the invention, the gemstone 10 has a total of 82 facets, including the culet 38.

The present invention uses unique combination of angles and faceting to create a gemstone with an equal number of facets in the crown and the pavilion, and with a pavilion having facets which are formed at three different angles. The combination of the use of greater number of facets and different angles of faceting, particularly, the different angles used in faceting the pavilion, creates a gemstone with enhanced characteristics of scintillation, brilliance and dispersion.

In one embodiment of the invention, the amount of light return of the gemstone is in the range of 92% to 95%. This amount is greater than the amount of light returned by a conventional round brilliant cut gemstone which generally has a light return of about 82% to 86%. This gives the gemstone of the present invention enhanced brilliance as compared to a conventional round brilliant cut gemstone.

The light spread of the gemstone of the invention is preferably in the range of 5% to 6%. This is greater than the light spread of a conventional round brilliant cut gemstone which generally has a light spread of only about 2% to 3%. This gives the gemstone of the present invention better dispersion of light as compared to a conventional round brilliant cut gemstone.

Figure 4:
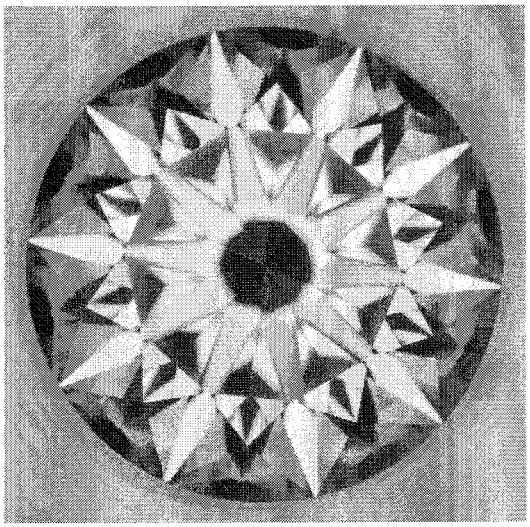
FIG. 4 is a plan view showing arrow pattern and floral pattern in the gemstone of an embodiment of the present invention.
Figure 5:
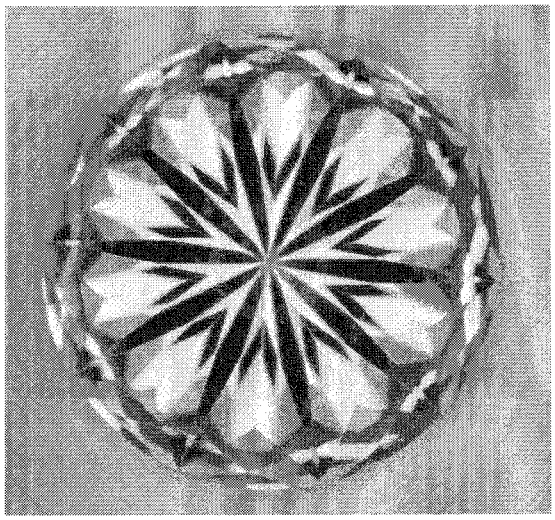
FIG. 5 is a plan view showing heart pattern in the gemstone of an embodiment of the present invention.

It should also be noted that the unique facets arrangement of the present invention is able to yield a hearts and arrows pattern with an enhanced view of a floral pattern, as depicted in FIGS. 4 and 5. When the gemstone 10 of the present invention is viewed in a face-up direction (table up position) using a magnifying device, ten arrows and floral pattern may be observed as shown in FIG. 4. When the gemstone 10 of the present invention is viewed in a face-down direction (viewed through the pavilion), ten hearts pattern may be observed as shown in FIG. 5. This hearts and arrows as well as the floral phenomenon is unique to the gemstone 10 of the present invention.

In one embodiment of the invention, the gemstone 10 is a diamond. The gemstone 10 can be of any dimension, size, or weight.

The present invention also contemplates methods for forming the embodiment of the gemstone 10 as described above.

According to one embodiment of the invention, a method of cutting a gemstone having a crown, a girdle and a pavilion is provided. The method comprises forming ten pavilion main facets 24 at the pavilion 12 of the gemstone, at an angle between 40.75° and 41.50° relative to the plane parallel to the horizontal plane of the girdle. Each of the pavilion main facets 24 extends concentrically from the culet 38. In one embodiment of the invention, the pavilion main facets 24 are formed at an angle of 41° relative to the plane parallel to the horizontal plane of the girdle.

The method further comprises forming twenty substantially triangular pavilion hook facets 29 on the pavilion 12, at an angle between 41.50° and 42.25° relative to the plane parallel to the horizontal plane of the girdle and aligning the pavilion hook facets 29 between the pavilion main facets.

In one embodiment of the invention, the pavilion hook facets 29 are formed at an angle of 41.75° relative to the plane parallel to the horizontal plane of the girdle.

The method further comprises forming ten substantially triangular pavilion star facets 34 around the periphery of the pavilion 12, at an angle between 45.75° and 46.50° relative to the plane parallel to the horizontal plane of the girdle and aligning the pavilion star facets 34 between the pavilion hook facets 29. In one embodiment of the invention, the pavilion star facets 34 are formed at an angle of 46° relative to the plane parallel to the horizontal plane of the girdle.

The method of the present invention further comprises forming a table 14 at the crown 11 of the gemstone, forming ten star facets 15 surrounding the table 14, forming ten bezel facets 16 and aligning each of the bezel facets 16 between the star facets 15 and forming twenty upper girdle facets 20. Each of the upper girdle facets 20 is aligned adjacent to, and forming a common edge with another upper girdle facet 20 to form a pair of upper girdle facets. Each of the pairs of upper girdle facets is aligned between two adjacent bezel facets 16.

It should be noted that the sequence of forming the gemstone of the present invention is irrelevant, so long as the resulting gemstone has the arrangement of facets as described above.

The foregoing describes the invention including preferred forms thereof. Alterations and modifications as will be obvious to those skilled in the art are intended to be incorporated within the scope hereof as defined by the accompanying claims.

The invention claimed is:

1. A diamond, comprising:

a girdle;

a crown extending in a first direction from the girdle, the crown comprising:

a table, ten star facets surrounding the table, and ten bezel facets aligned between the star facets and twenty upper girdle facets aligned between the bezel facets; and a pavilion extending in a second direction from the girdle, opposite the first direction, the pavilion consisting of:

ten pavilion main facets extending concentrically from a point of the pavilion distant from the girdle and formed at an angle between 40.75° and 41.50° relative to a plane parallel to a horizontal plane of the girdle, twenty substantially triangular pavilion hook facets aligned between the pavilion main facets and formed at an angle between 41.50° and 42.25° relative to a plane parallel to a horizontal plane of the girdle, wherein each of the pavilion hook facets is adjacent to, and forms a common edge with another pavilion hook facet to form a pair of pavilion hook facets, and each of the pair of pavilion hook facets is aligned between two adjacent pavilion main facets, and ten substantially triangular pavilion star facets aligned between the pavilion hook facets and formed at an angle between 45.75° and 46.50° relative to a plane parallel to a horizontal plane of the girdle, wherein the pavilion star facets are aligned around periphery of the pavilion and each pavilion star facet includes a first side forming a first common edge with a side of a first pavilion hook facet of the pair of pavilion hook facets and a second side forming a second common edge with a side of a second pavilion hook facet of the pair of pavilion hook facets.

2. The gemstone according to claim 1, wherein the pavilion main facets are formed at an angle of 41°, relative to the plane parallel to the horizontal plane of the girdle.

3. The gemstone according to claim 1, wherein the pavilion hook facets are formed at an angle of 41.75°, relative to the plane parallel to the horizontal plane of the girdle.

4. The gemstone according to claim 1, wherein the pavilion star facets are formed at an angle of 46°, relative to the plane parallel to the horizontal plane of the girdle.

5. The gemstone according to claim 1, wherein the pavilion main facets are formed at an angle of 41°, the pavilion hook facets are formed at an angle of 41.75° and the pavilion star facets are formed at an angle of 46°, relative to the plane parallel to the horizontal plane of the girdle.

6. The gemstone according to claim 1, wherein each of the upper girdle facets is aligned adjacent to, and forming a common edge with another upper girdle facet to form a pair of upper girdle facets, each of the pair of upper girdle facets is aligned between two adjacent bezel facets.

7. The gemstone according to claim 6, wherein a projection of ten heart shapes, ten arrow shapes and a floral pattern are observed when the gemstone is exposed to light.

8. The gemstone according to claim 1, wherein each of the ten bezel facets extends from the table to the girdle.

9. The gemstone according to claim 8, wherein each of the ten bezel facets is in a shape of a four-sided kite.

* * * * *